US005322358A

United States Patent [19]

Coho et al.

[11] Patent Number: 5,322,358

[45] Date of Patent: Jun. 21, 1994

[54] COSMETIC CONTAINER SHAKERS

[76] Inventors: Denise Coho; Eddy Peiffer, both of 201 Five Cities Dr., SP 122, Pismo Beach, Calif. 93449

[21] Appl. No.: 130,696

[22] Filed: Oct. 4, 1993

[51] Int. Cl.[5] ..... B01F 11/00

[52] U.S. Cl. ..... 366/214; 366/235; 366/605

[58] Field of Search ..... 366/213, 214, 218, 219, 366/220, 233, 235, 605, 53, 54, 601, 204, 347

[56] References Cited

U.S. PATENT DOCUMENTS

| | | | |
|---|---|---|---|
| 3,614,434 | 7/1968 | Horwitz | 366/214 |
| 3,747,900 | 7/1973 | Dilts | 366/214 |
| 4,329,068 | 5/1982 | Neuner | 366/214 |
| 4,568,194 | 2/1986 | Gargioni | 366/213 |

FOREIGN PATENT DOCUMENTS

| | | | |
|---|---|---|---|
| 1420663 | 1/1976 | United Kingdom | 366/213 |

*Primary Examiner*—Robert W. Jenkins
*Attorney, Agent, or Firm*—Hugh E. Smith

[57] ABSTRACT

The present invention relates to a portable shaker for cosmetic containers such as nail enamel. The shaker includes a frame assembly, a motor, power transfer means and an upper cylindrical housing. The frame assembly includes a rectangular frame element with two triangular uprights at either end. Mounted to the triangular uprights is the upper cylindrical housing. The housing includes an internal foam bottle holder with recesses adapted to hold bottles of cosmetic product. The motor and power transfer mechanisms serve to rotate the cylindrical housing by way of a beveled gear system.

4 Claims, 4 Drawing Sheets

COSMETIC CONTAINER SHAKERS

BACKGROUND OF THE INVENTION

1. Field of the Invention

The present invention relates to a portable shaking device and more particularly pertains to a portable shaking device specifically adapted to shake containers of cosmetic products, such as fingernail polish, to homogenize the fluid and render it more functional, and appealing to the eye. This would limit sending back of damange goods and hours of manual labor.

2. Description of the Prior Art

The use of shaking devices is known in the prior art. More specifically, shaking devices heretofore devised and utilized for the purpose of shaking containers are known to consist basically of familiar, expected and obvious structural configurations, notwithstanding the myriad of designs encompassed by the crowded prior art which have been developed for the fulfillment of countless objectives and requirements.

Of interest is U.S. Pat. No. 4,842,415 which discloses a paint shaker. The paint shaker is for use in in-store paint tinting operations. The shaker includes a clamping member detection means which does not allow a shaking operation to start until a container is clamped.

Another patent of interest is U.S. Pat. No. 4,497,581 which illustrates a paint shaker The shaker is designed for agitating and mixing paint and/or flowable materials in a container. The shaker includes a bucket having an open upper end for receiving the container and mounted to rotate around an upwardly sloping axis.

U.S. Pat. No. Des. 259,425 illustrates the design of a vibratory device for cleaning jewelry and the like.

U.S. Pat. No. 4,619,532 discloses a shaker for paint containers. The shaker includes an electric motor which depends from a motor mounting plate and has an eccentric flyweight secured to its output shaft.

Yet another patent of interest is U.S. Pat. No. 4,422,768 which discloses a paint can shaker. The paint can shaker includes a frame and a paint can carrier mounted on the frame and adapted to receive and support a paint can. The carrier is enabled to undergo rolling vibratory motion relative to a supporting surface.

In this respect, the portable shaker according to the present invention substantially departs from the conventional concepts and designs of the prior art and in so doing provides an apparatus primarily developed for the purpose of mixing containers of cosmetic products to stir any settled content layers. Furthermore, the device provides a rotary cylindrical housing adapted to receive a number of containers of cosmetic product.

Therefore, it can be appreciated that there exists a continuing need for new and improved shakers that can be used for making settled cosmetic fluids of a homogenius and visually prefered appearance. In this regard, the present invention substantially fulfills this need.

SUMMARY OF THE INVENTION

In view of the foregoing disadvantages inherent in the known types of shakers now present in the prior art, the present invention provides an improved cosmetic container shaker construction wherein the same can be utilized for unsettling the contents of the containers. As such, the general purpose of the present invention, which will be described subsequently in greater detail, is to provide a new and improved cosmetic container shaker apparatus and method which has all the advantages of the prior art shakers and none of the disadvantages.

To attain this, the present invention essentially comprises of a portable shaker adapted for shaking containers with fluid cosmetic products, the portable shaker comprising a rectangular frame element having a first side end, a second side end, a forward portion and a rearward portion; a first triangular upright having a lower base, an upper apex, the lower base being integral with the first end of the frame element, a semi circular recess formed within the upper apex of the first upright; a second triangular upright having a lower base, an upper apex, the lower base being integral with the second end of the frame element, a semi circular recess formed within the upper apex of the second upright; a motor housing integral with the forward portion of the frame element at the first end of the frame element; an electric motor secured within the motor housing, the electric motor having a vertical bevel gear as an output; a three way switch positioned within the motor housing, the three way switch serving to operate the electric motor at one of three speeds; a drive shaft housing having a lower extent and an upper extent, the drive shaft housing being integral with the first triangular upright, the upper extent of the drive shaft housing being integral with the first upper apex and the lower extent being integral with the first lower base; a drive shaft having an upper extent and a lower extent, the drive shaft being mounted within the drive shaft housing; a lower horizontal bevel gear mounted upon the drive shaft at its lower extent, the lower bevel gear being intermeshed with the vertical bevel gear of the electric motor; an upper horizontal bevel gear mounted upon the drive shaft at its upper extent; a major housing portion having a first end, a second end, a lower longitudinally extending edge and an upper longitudinally extending edge, the major housing portion defined by a 270 degree hollow cylindrical wedge; a housing door having a first end, a second end, a lower longitudinally extending edge, an upper longitudinally extending edge, the housing door defined by a 90 degree hollow cylindrical wedge, the upper edge of the housing being pivoted along the upper edge of the major housing portion; a cylindrical housing formed by the coupling of the housing door and major housing portion and having a first end and a second end, a first aperture formed centrally within the first end, and a second aperture formed centrally within the second end, the cylindrical housing defined by the 90 degree hollow cylindrical wedge of the housing door, and the 270 degree hollow cylindrical wedge of the major housing portion; a mounting shaft having a first end and a second end, the mounting shaft positioned centrally within the cylindrical housing through the first and second apertures of the cylindrical housing; a vertical bevel gear mounted upon the first end of the mounting shaft and intermeshed with the upper horizontal bevel gear; a foam bottle holder positioned within the interior of the cylindrical housing, the foam bottle holder formed from a 90 degree wedge and a 270 degree wedge with a plurality of recesses formed in the 270 degree wedge for receiving containers to be shaken.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cosmetic container shaker which has all the advantages of the prior art cosmetic container shakers and none of the disadvantages.

It is another object of the present invention to correct the stratification of cosmetic fluids to render them more useable for their intended functions.

It is another object of the present invention to provide a new and improved cosmetic container shaker which may be easily and efficiently manufactured and marketed.

It is a further object of the present invention to provide a new and improved cosmetic container shaker which is of a durable and reliable construction.

An even further object of the present invention is to provide a new and improved cosmetic container shaker which is susceptible of a low cost of manufacture with regard to both materials and labor, and which accordingly is then susceptible of low prices of sale to the consuming public, thereby making such cosmetic container shakers economically available to the buying public.

Still yet another object of the present invention is to provide a new and improved cosmetic container shaker which provides in the apparatuses and methods of the prior art some of the advantages thereof, while simultaneously overcoming some of the disadvantages normally associated therewith.

Lastly, it is an object of the present invention to provide a portable shaker adapted to shake containers of fluid products, the portable shaker comprising a frame element having a first end, a second end, a forward portion and a rearward portion; a first triangular upright having a lower base and an upper apex, the lower base being integral with the first end of the frame element; a second triangular upright having a lower base and an upper apex, the lower base being integral with the second end of the frame element; an electric motor positioned upon the frame element, the motor having a vertical bevel gear as an output; a drive shaft having an upper extent and a lower extent, the upper extent of the shaft being positioned at the upper apex of the first upright and the lower extent of the shaft being positioned at the lower base of the first upright; a lower horizontal bevel gear mounted upon the drive shaft at its lower extent, the lower bevel gear being intermeshed with the vertical bevel gear of the electric motor; an upper horizontal bevel gear mounted upon the drive shaft at its upper extent; a housing door having a first end, a second end, a lower longitudinally extending edge, an upper longitudinally extending edge, the housing door defined by a minor hollow cylindrical wedge; a major housing portion having a first end, a second end, a lower longitudinally extending edge and an upper longitudinally extending edge, the major housing portion defined by a major hollow cylindrical wedge, the upper edge of the major housing portion being pivoted along the upper edge of the housing door; a vertical bevel gear connected with the first end of the major cylindrical housing and intermeshed with the upper horizontal bevel gear; and a foam bottle holder positioned within the interior of the cylindrical housing, the foam bottle holder formed from a minor wedge and a major wedge with a plurality of recesses formed in the major wedge for receiving containers to be shaken.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
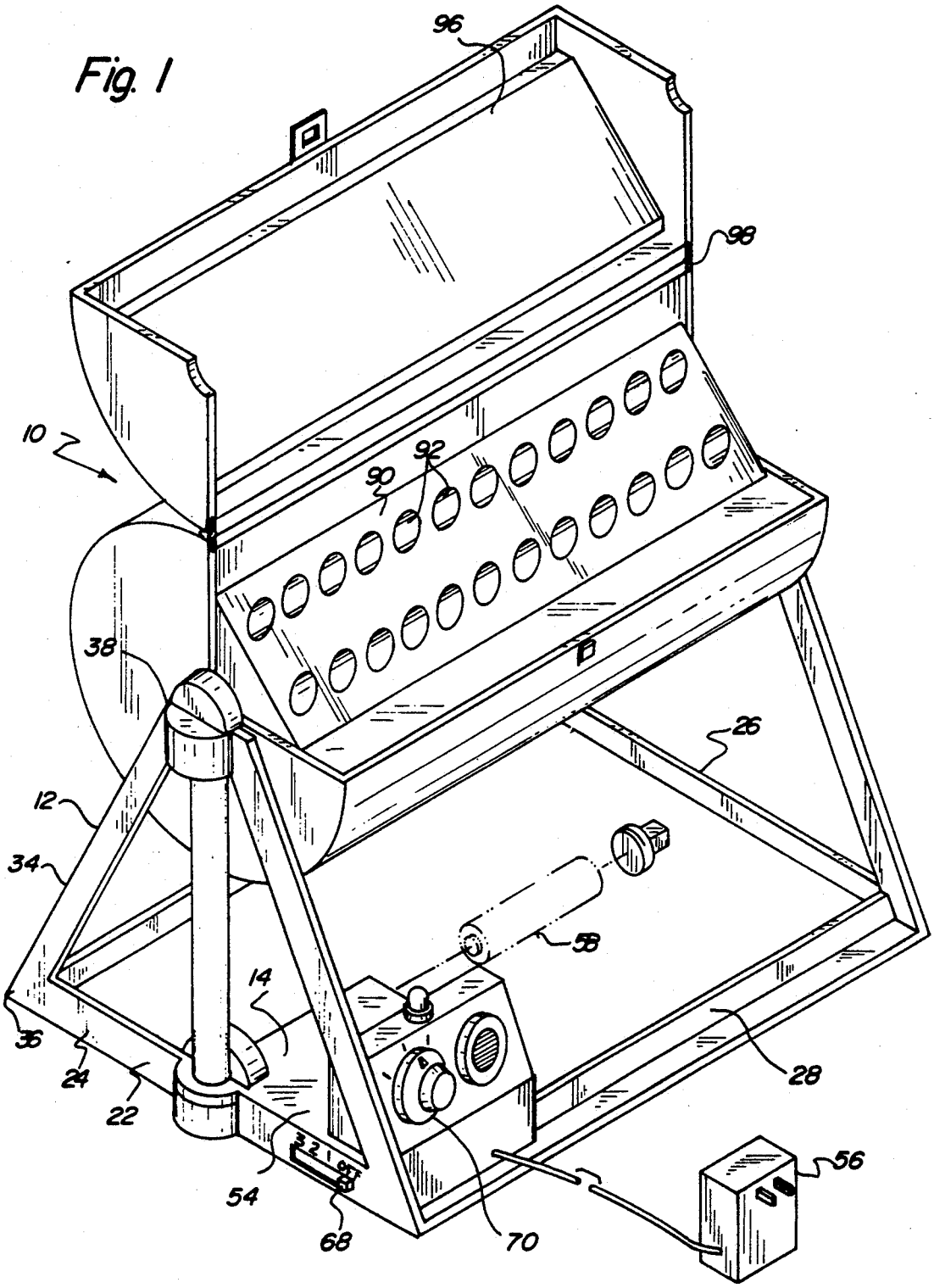
FIG. 1 is a perspective illustration of a fully assembled cosmetic container shaker constructed in accordance with the principles of the present invention.
Figure 3:
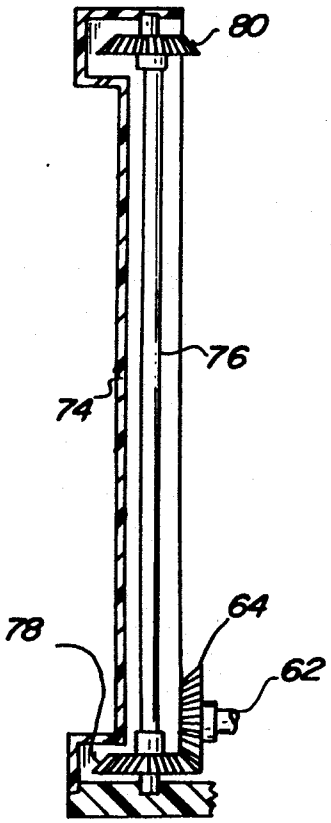
FIG. 3 is a sectional view taken along line 3—3 of FIG. 2.
Figure 2:
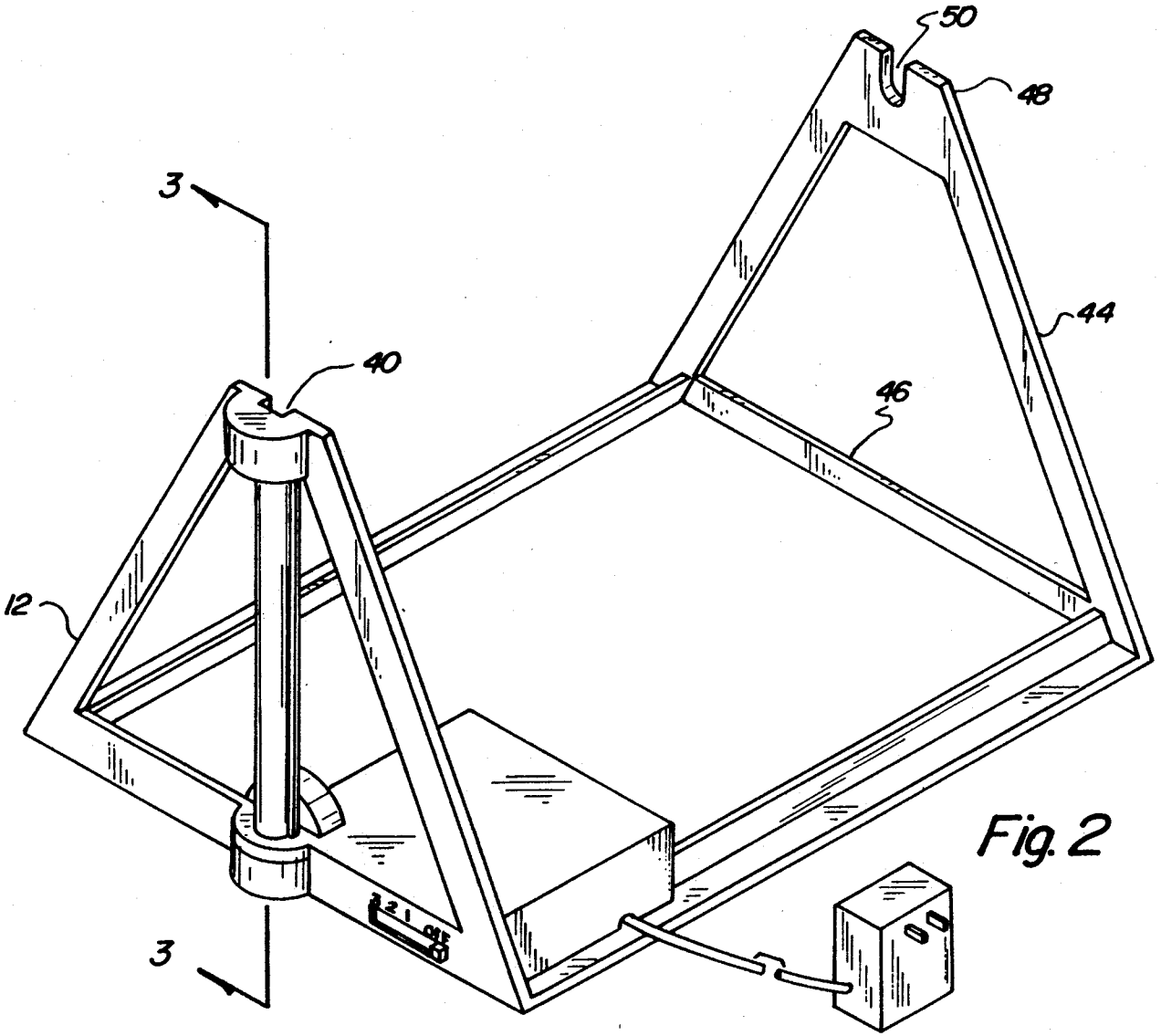
FIG. 2 is a perspective view of the frame assembly of the shaker shown in FIG. 1.
Figures 4, 5:
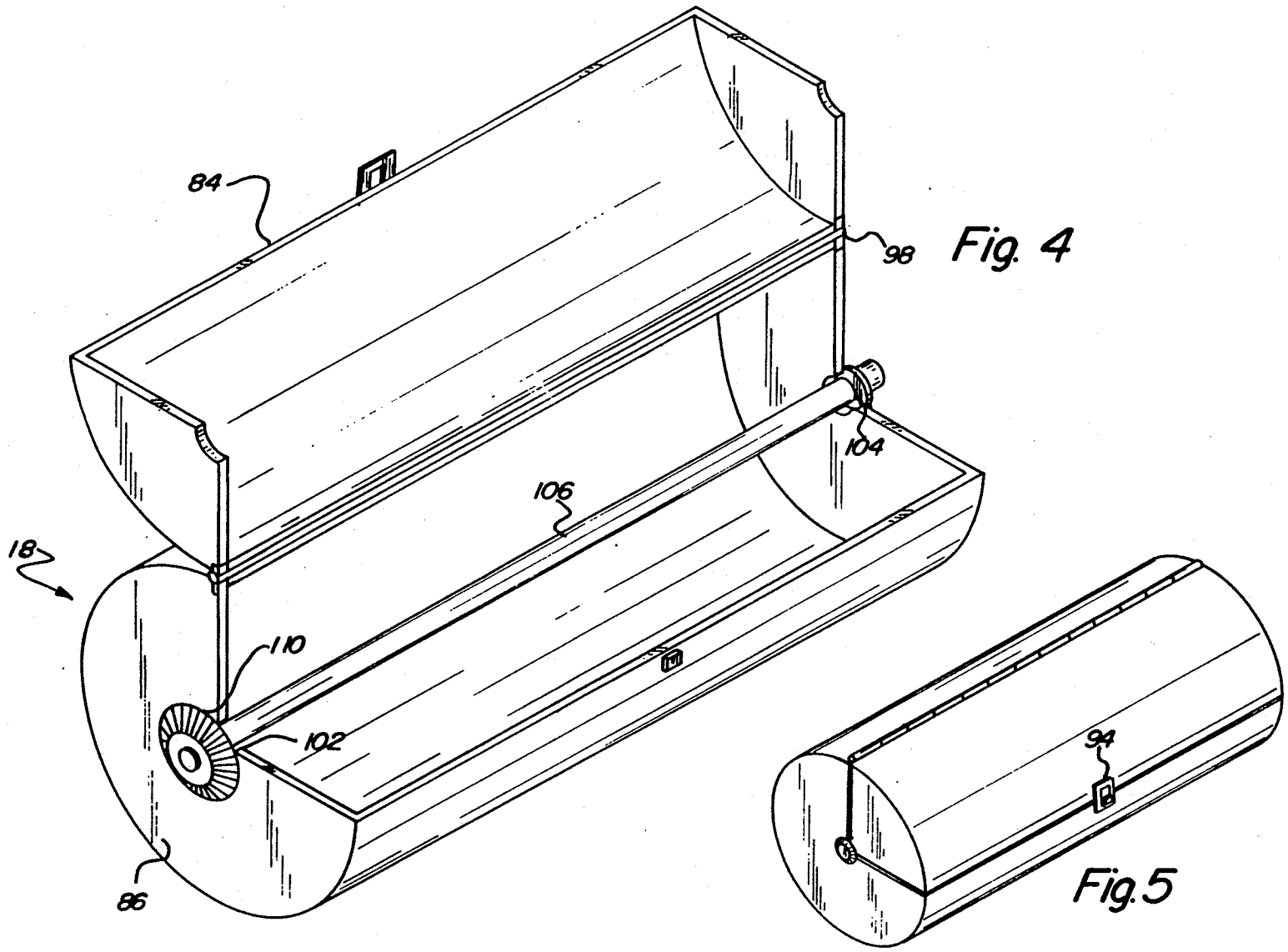
FIG. 4 is a perspective illustration of the housing in a open orientation as employed in the cosmetic container shaker of FIG. 1.
FIG. 5 is an perspective illustration of the housing shown in FIG. 4 but in the closed condition.
Figures 6, 7:
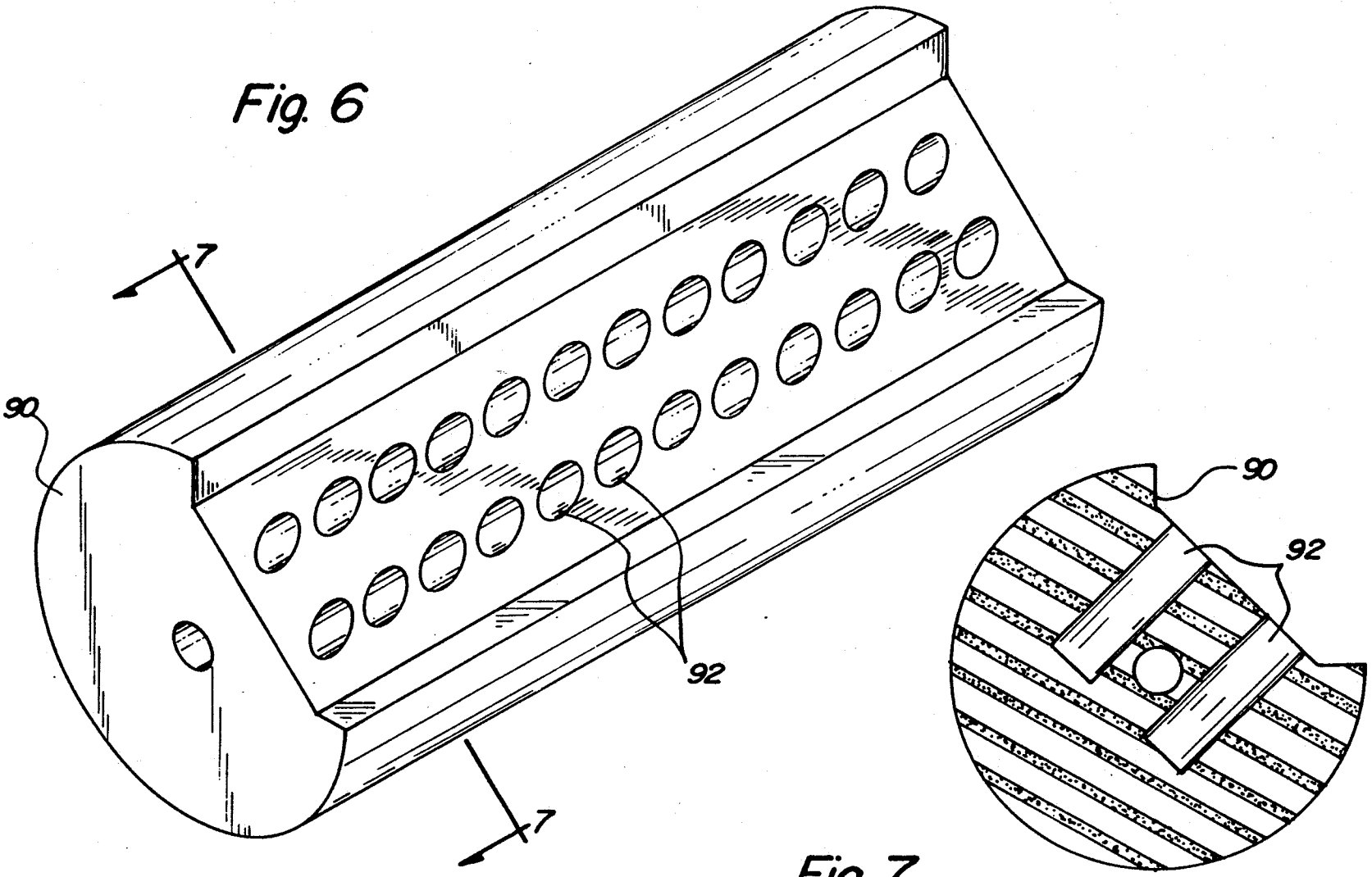
FIG. 6 is a perspective illustration of the foam bottle holder of the cosmetic container shaker of FIG. 1 adapted to be positioned within the housing of FIGS. 1 and 4.
FIG. 7 is a sectional view taken along line 7—7 of FIG. 6.

With reference to the drawings, and in particular to FIG. 1 thereof, a new and improved portable shaker embodying the principles and concepts of the present invention and generally designated by the reference numeral 10 will be described.

The present invention relates to a portable shaker 10 adapted for shaking containers of cosmetic products not shown. The portable shaker, in general terms, includes a lower frame assembly 12, a motor 14, power transfer means 16, and an upper cylindrical housing assembly 18.

The frame assembly 12 includes a rectangular frame element 22 having a first side end 24, a second side end 26, a forward portion 28 and a rearward portion 30. The frame element is dimensioned so as to easily fit upon a desk or countertop. Integral with the frame assembly are two triangular uprights. The first triangular upright 34 has a lower base 36 and an upper apex 38, with the lower base being integral with the first end of the frame element. The first triangular upright further includes a semi circular recess 40 formed within the upper apex of the upright. The second triangular upright 44 has a lower base 46, an upper apex 48, with the lower base being integral with the second end of the frame element. The second triangular upright further includes a semi circular recess 50 formed within the upper apex of the upright.

The motor 14 and power transfer means 16 will now be described. The power means includes a motor housing 54 which is integral with the forward portion of the frame element at the first end of the frame element. Positioned within the motor housing is an electric motor 14. The electric motor can be powered by an external source of power through a plug 56, or alternatively can be power by batteries 58 positioned within the motor housing. The electric motor has an output shaft 62 which is coupled to a vertical bevel gear 64.

A three way switch 68 is positioned within the motor housing. The three way switch serves to operate the electric motor at any one of three rotational speeds.

A timer 70 is set to determine running time for a particular application. Connected with the first triangular upright is a drive shaft housing 74. The drive shaft housing has a lower extent and an upper extent. The upper extent of the drive shaft housing is integral with the upper apex of the upright, and the lower extent of the drive shaft is integral with the lower base of the upright.

Mounted within the drive shaft housing is a drive shaft 76. The drive shaft has an upper extent and a lower extent. A lower horizontal bevel gear 78 is mounted upon the drive shaft at its lower extent. The lower bevel gear 78 is intermeshed with the vertical bevel gear 64 of the electric motor. An upper horizontal bevel gear 80 mounted upon the drive shaft at its upper extent.

The upper cylindrical housing assembly 18 will now be described. The upper cylindrical housing includes a housing door 84 and a major housing portion 86. The housing door 84 has a first end, a second end, a lower longitudinally extending edge, and an upper longitudinally extending edge. The housing door 84 is defined by a 90 degree hollow cylindrical wedge. The major housing portion has a first end, a second end, a lower longitudinally extending edge and an upper longitudinally extending edge. The major housing portion is defined by a 270 degree hollow cylindrical wedge.

A hinge 98 extends along the upper edge of the major housing and serves to pivotally connect the upper edge of the major housing with the upper edge of the housing door.

Positioned within the major housing portion is a foam bottle holder 90. the foam bottle holder is constructed from any commercially available foam material preferably polyurethane foam. the bottle holder 90 is securely positioned and frictionally held within the major housing portion 86 such as to not allow angular movement between the bottle holder and the housing portion.

The bottle holder includes a plurality of recesses 92. The recesses are specifically adapted by their size and shape to receive containers of cosmetics such as nailpolish. The apertures of the bottle holder are accessible when the housing door 84 is opened. Secure coupling of the housing portions is through lock 94. Furthermore, the hollow interior portion of the housing door is fitted with a foam section 96. The foam section 96 is curved portion to conform to the interior of the housing door 84 and an opposite planar surface serves to cover the recesses 92 of the bottle holder whenever the housing door is closed.

The major housing portion 86 and the housing door 84 together serve to define a cylindrical housing 18. The cylindrical housing 18 has a first end, a second end, a first aperture 102 formed centrally within the first end, and a second aperture 104 formed centrally within the second end. A mounting shaft 106 having a first end and a second end is positioned centrally within the cylindrical housing. The mounting shaft is positioned such that it extends through the first and second apertures of the cylindrical housing and the semi circular recesses 40 and 50 of the first and second uprights. A vertical bevel gear 110 is mounted upon the first end of the mounting shaft. The vertical bevel gear 110 is intermeshed with the upper horizontal bevel gear 80 of the drive shaft.

In use, the shaker is transported to the location in which it is desired to be used. The shaker is dimensioned to fit upon a table or desktop surface for both commercial and/or domestic use. If batteries are not used, the shaker is coupled to an external source of power. The operator then open the housing door of the cylindrical housing to reveal the plurality of apertures of the foam section. Cosmetic containers with stratified fluid contents to be homogenized are then placed within the apertures, the operator then closes the housing door. With the door closed the operator turns on the shaker and selects one of three operating speeds. When in operation, the motor transfers power through the drive shaft and bevel gear system to the cylindrical housing, thereby rotating the cylindrical housing. When fully shaken, the door is open and the contents removed to provide cosmetics ready for use and display.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable shaker adapted for shaking containers with fluid cosmetic products, the portable shaker comprising:

a rectangular frame element having a first side end, a second side end, a forward portion and a rearward portion;

a first triangular upright having a lower base, an upper apex, the lower base being integral with the first end of the frame element, a semi circular recess formed within the upper apex of the first upright;

a second triangular upright having a lower base, an upper apex, the lower base being integral with the second end of the frame element, a semi circular recess formed within the upper apex of the second upright;

a motor housing integral with the forward portion of the frame element at the first end of the frame element;

an electric motor secured within the motor housing, the electric motor having a vertical bevel gear as an output;

a three way switch positioned within the motor housing, the three way switch serving to operate the electric motor at one of three speeds;

a drive shaft housing having a lower extent and an upper extent, the drive shaft housing being integral with the first triangular upright, the upper extent of the drive shaft housing being integral with the first upper apex and the lower extent being integral with the first lower base;

a drive shaft having an upper extent and a lower extent, the drive shaft being mounted within the drive shaft housing;

a lower horizontal bevel gear mounted upon the drive shaft at its lower extent, the lower bevel gear being intermeshed with the vertical bevel gear of the electric motor;

an upper horizontal bevel gear mounted upon the drive shaft at its upper extent;

a major housing portion having a first end, a second end, a lower longitudinally extending edge and an upper longitudinally extending edge, the major housing portion defined by a 270 degree hollow cylindrical wedge;

a housing door having a first end, a second end, a lower longitudinally extending edge, an upper longitudinally extending edge, the housing door defined by a 90 degree hollow cylindrical wedge, the upper edge of the housing being pivoted along the upper edge of the major housing portion;

a cylindrical housing formed by the coupling of the housing door and major housing portion and having a first end and a second end, a first aperture formed centrally within the first end, and a second aperture formed centrally within the second end, the cylindrical housing defined by the 90 degree hollow cylindrical wedge of the housing door, and the 270 degree hollow cylindrical wedge of the major housing portion;

a mounting shaft having a first end and a second end, the mounting shaft positioned centrally within the cylindrical housing through the first and second apertures of the cylindrical housing;

a vertical bevel gear mounted upon the first end of the mounting shaft and intermeshed with the upper horizontal bevel gear;

a foam bottle holder positioned within the interior of the cylindrical housing, the foam bottle holder formed from a 90 degree wedge and a 270 degree wedge with a plurality of recesses formed in the 270 degree wedge for receiving containers to be shaken.

2. A portable shaker adapted to shake containers of fluid products, the portable shaker comprising:

a frame element having a first end, a second end, a forward portion and a rearward portion;

a first triangular upright having a lower base and an upper apex, the lower base being integral with the first end of the frame element;

a second triangular upright having a lower base and an upper apex, the lower base being integral with the second end of the frame element;

an electric motor positioned upon the frame element, the motor having a vertical bevel gear as an output;

a drive shaft having an upper extent and a lower extent, the upper extent of the shaft being positioned at the upper apex of the first upright and the lower extent of the shaft being positioned at the lower base of the first upright;

a lower horizontal bevel gear mounted upon the drive shaft at its lower extent, the lower bevel gear being intermeshed with the vertical bevel gear of the electric motor;

an upper horizontal bevel gear mounted upon the drive shaft at its upper extent;

a housing door having a first end, a second end, a lower longitudinally extending edge, an upper longitudinally extending edge, the housing door defined by a minor hollow cylindrical wedge;

a major housing portion having a first end, a second end, a lower longitudinally extending edge and an upper longitudinally extending edge, the major housing portion defined by a major hollow cylindrical wedge, the upper edge of the major housing portion being pivoted along the upper edge of the housing door;

a vertical bevel gear connected with the first end of the major cylindrical housing and intermeshed with the upper horizontal bevel gear; and a foam bottle holder positioned within the interior of the cylindrical housing, the foam bottle holder formed from a minor wedge and a major wedge with a plurality of recesses formed in the major wedge for receiving containers to be shaken.

3. The portable shaker of claim 2 and further including control means for activating and inactivating the motor.

4. The portable shaker of claim 2 and further including a timing mechanism coupled to the electric motor, the timing mechanism serving to start and stop the motor at selected times.

* * * * *